US007559586B2

(12) United States Patent
Fukunaga et al.

(10) Patent No.: US 7,559,586 B2
(45) Date of Patent: Jul. 14, 2009

(54) DOOR LOCK APPARATUS FOR A VEHICLE

(75) Inventors: Katsutoshi Fukunaga, Chiryu (JP); Makoto Suzumura, Chita (JP); Akira Muramatsu, Chiryu (JP); Sigeru Tanabe, Obu (JP); Yukinobu Kunimatsu, Toyoake (JP); Kazuhisa Hidaka, Toyota (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 293 days.

(21) Appl. No.: 11/357,107

(22) Filed: Feb. 21, 2006

(65) Prior Publication Data

US 2006/0186676 A1 Aug. 24, 2006

(30) Foreign Application Priority Data

Feb. 23, 2005 (JP) ..... 2005-047499
Mar. 25, 2005 (JP) ..... 2005-089425

(51) Int. Cl.
*E05C 3/16* (2006.01)
*E05C 3/06* (2006.01)

(52) U.S. Cl. ..... 292/216; 292/201; 292/DIG. 23

(58) Field of Classification Search ..... 292/201, 292/216, DIG. 23
See application file for complete search history.

(56) References Cited

U.S. PATENT DOCUMENTS 4,934,746 A * 6/1990 Yamada ..... 292/201
6,131,967 A * 10/2000 Kondo et al. ..... 292/201
6,412,222 B1 7/2002 Hashiba et al.
7,021,681 B2 4/2006 Hayakawa et al.
7,390,034 B2 * 6/2008 Inoue ..... 292/10
2004/0036298 A1 2/2004 Hayakawa et al.

FOREIGN PATENT DOCUMENTS

| | | |
|---|---|---|
| DE | 103 23 888 A1 | 2/2004 |
| GB | 2 247 493 A | 3/1992 |
| GB | 2 337 295 A | 11/1999 |
| JP | 2004-44360 A | 2/2004 |
| TW | 493672 | 7/2002 |
| TW | 505583 | 10/2002 |
| TW | 515474 | 12/2002 |

OTHER PUBLICATIONS

European Search Report issued by the European Patent Office on Oct. 12, 2006 in corresponding European Patent Application No. 06 10 1697, Munich, Germany.
Taiwan IPO Search Report.

* cited by examiner

*Primary Examiner*—Carlos Lugo
(74) *Attorney, Agent, or Firm*—Buchanan Ingersoll & Rooney PC

(57) ABSTRACT

A door lock apparatus includes: a link member interposed between a latch mechanism and an open lever and selectively operated between an unlock position and a lock position, the unlock position in which an operation of the open lever is transmitted to the latch mechanism, and the lock position in which the operation is not transmitted to the latch mechanism; and a lock operation lever including an active lever and a sub lever, the sub lever configured to operate integrally with the active lever when the link member is switched to the lock position and to cooperate with the active lever via a biasing member when the link member is switched to the unlock position. The lock operation lever is an assembly containing the active lever, the sub lever and the biasing member.

19 Claims, 11 Drawing Sheets

Unlock State

Lock State

Lock State (Open Lever Operated)

DOOR LOCK APPARATUS FOR A VEHICLE

CROSS REFERENCE TO RELATED APPLICATIONS

This application is based on and claims priority under 35 U.S.C. §119 with respect to Japanese Patent Application 2005-047499, filed on Feb. 23, 2005, and Japanese Patent Application 2005-089425, filed on Mar. 25, 2005 the entire content of which is incorporated herein by reference.

FIELD OF THE INVENTION

This invention generally relates to a door lock apparatus, which is configured to hold a door at a closed condition relative to a body and to lock the door. The door lock apparatus can be adapted to a vehicle.

BACKGROUND

Door lock apparatus have been conventionally known, which includes a latch mechanism, a lift lever, an open lever, a lock operation lever and a link member. For example, US2004036298A1 discloses such type of door lock apparatus. In this door lock apparatus, the latch mechanism can be adjusted to a vehicle door and can be engaged with, and disengaged from, a striker of a vehicle body. The lift lever is configured to operate the latch mechanism from an engaged condition, in which the latch mechanism is engaged with the striker, to a disengaged condition. The lock operation lever is configured to move between an unlock position and a lock position in response to operation of a lock-unlock member of a vehicle door. The link member operates via the open lever in response to operation of a door handle of the vehicle door and is configured to move between an unlock position and a lock position in association with the lock operation lever. When the link member is at the unlock position, the link member can be engaged with the lift lever in response to the operation of the open lever and can operate the lift lever in a direction, which leads to disengagement of a latch of the latch mechanism from the striker. On the other hand, when the link member is at the lock position, the link member misses the lift lever; in other words, the link member is not engaged with the lift lever. In such circumstances, the latch of the latch mechanism is not disengaged from the striker.

According to this type of door lock apparatus, under the door lock condition, if an operation of the door handle and an operation of a lock-unlock member such as a lock knob are implemented at or about the same time, at least the following could occur. That is, when the operation of the door handle is implemented earlier than the operation of the lock-unlock member, the link member misses the lift lever. The link member is then moved in a direction of the unlock position from a position at which the link member missed the lift lever, in response to the operation of the lock-unlock member. In such cases, because the link member comes in contact with the lift lever from a side at which the link member can not operate the lift lever, a door unlocking operation is disabled. As a result, a door opening operation is disabled. Such a situation is referred to as "a state of panic". Therefore, in order to switch a door condition from a door lock condition to the door unlock condition, it is necessary to carry out a door unlocking operation, after loosing the operation of the door handle and then shifting the link member to the position at which the link member can be engaged with the lift lever. Those operations, however, may on occasions appear unfavorable.

In order to solve such unfavorable operations, the door lock apparatus disclosed in JP2004-044360A includes the lock operation lever configured with an active lever, which is operatively associated with a lock-unlock member side, and a sub lever, which is provided so as to be movable relative to the active lever and is operatively associated with the link member side. The lock operation lever is further configured with a biasing member between the active lever and the sub lever.

According to the aforementioned configuration of the door lock apparatus, even if a panic state comes up due to the operation of the lock-unlock member that is implemented during the operation of the door handle, a relative movement of the sub lever and the active lever is still enabled. Even if the sub lever is at the panic state, the active lever can moved to the unlock position. In such conditions, in response to a return of the door handle, the engagement or contact between the link member and the lift lever is released, and the sub lever and the link member is shifted, by the biasing member, to the unlock position. As described above, even if a panic state comes up due to an operation of the lock-unlock member implemented at or about the same time as an operation of the door handle, it is possible to smoothly switch a door condition from the door lock condition to the door unlock condition.

According to the above-described conventional door lock apparatus, in order to assemble the lock operation lever to the door lock apparatus, it was necessary to build the active lever, the sub lever and the biasing member respectively relative to the door lock apparatus. More specifically, the active lever is first placed at a predetermined position relative to a base member of the door lock apparatus, and the biasing member is mounted on the active lever placed at the predetermined position. The sub lever is then mounted on the biasing member mounted on the active lever. Here, a connecting shaft of the sub lever extends through a bore of the active lever and a bore of the base member, and the lock operation lever is assembled to the door lock apparatus, while positions of the sub lever and the biasing member are supported relative to the active lever. However, an assembling process of the lock operation lever to the door lock apparatus remains complicated, in which an assembling efficiency goes down. Moreover, a manufacturing process of the door lock apparatus may become complicated.

The present invention has been made in view of the above circumstances, and provides a door lock apparatus used in a vehicle for example, in which respective members configuring a lock operation lever can be assembled to the door lock apparatus at an enhanced assembling efficiency, and a process of manufacturing the door lock apparatus can be simplified.

SUMMARY OF THE INVENTION

According to an aspect of the present invention, a door lock apparatus for a vehicle includes: a latch mechanism holding a door at a closed condition relative to a body; an inside open lever and an outside open lever activated in response to operations of door handles provided inside and outside the door; a link member interposed between the latch mechanism and the inside open lever and the outside open lever and selectively operated between an unlock position and a lock position, the unlock position in which operations of the respective inside and outside open levers are transmitted to the latch mechanism, and the lock position in which the operations are not transmitted to the latch mechanism; a drive unit activated to switch a position of the link mechanism between the unlock position and the lock position; and a lock operation lever configured to transmit a driving power source of the drive unit to the link member and including an active lever operatively associated with the drive unit and a sub lever operatively associated with the link member, the sub lever configured to operate integrally with the active lever when the link member is switched to the lock position and to cooperate with the active lever via a biasing member when the link member is switched to the unlock position. The lock operation lever is an assembly containing the active lever, the sub lever and the biasing member.

BRIEF DESCRIPTION OF THE DRAWINGS

The foregoing and additional features and characteristics of the present invention will become more apparent from the following detailed description considered with reference to the accompanying drawings, wherein.

DETAILED DESCRIPTION

An embodiment of the present invention will be described hereinbelow in detail with reference to the accompanying drawings.

Figure 10:
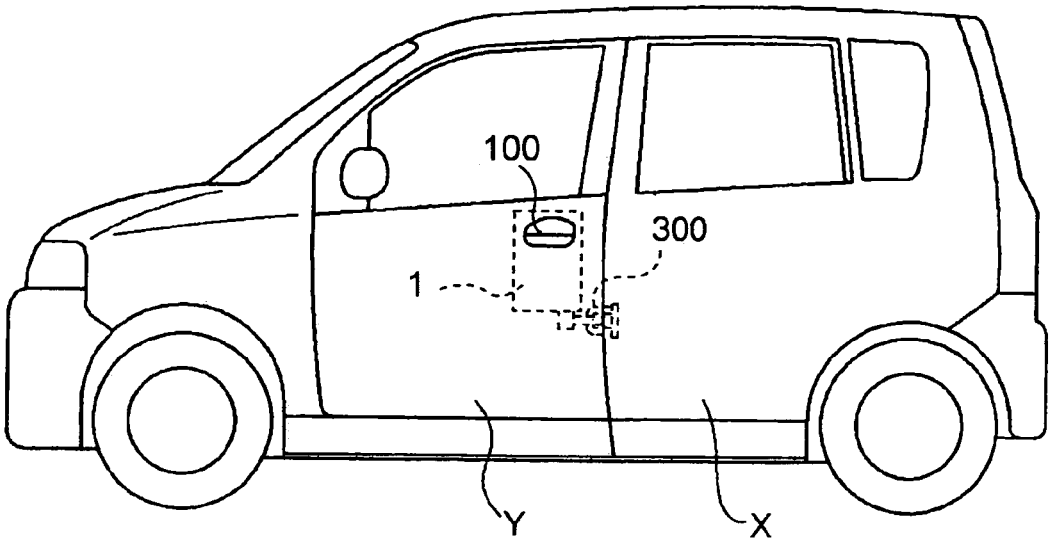
FIG. 10 is a schematic view illustrating a condition in which the door lock apparatus is installed at a door of a vehicle.

As illustrated in FIG. 10, a door lock apparatus 1 according to an embodiment of the present invention is installed at a position of a door Y of a vehicle X, a position which faces a striker 300 of the vehicle X when the door Y is closed. A type of the door Y is not limited specifically and can be a hinge-type door, a slide-type door and so on. According to the embodiment of the present invention, the door lock apparatus 1 is mounted on a side door as the door Y by which an occupant can get on and off the vehicle X, as is apparent from FIG. 10. The door lock apparatus 1 can be however mounted on a trunk lid of a vehicle such as a hatchback-type vehicle. The door lock apparatus 1 is fixedly provided at an inner side of the vehicle X.

Figure 1:
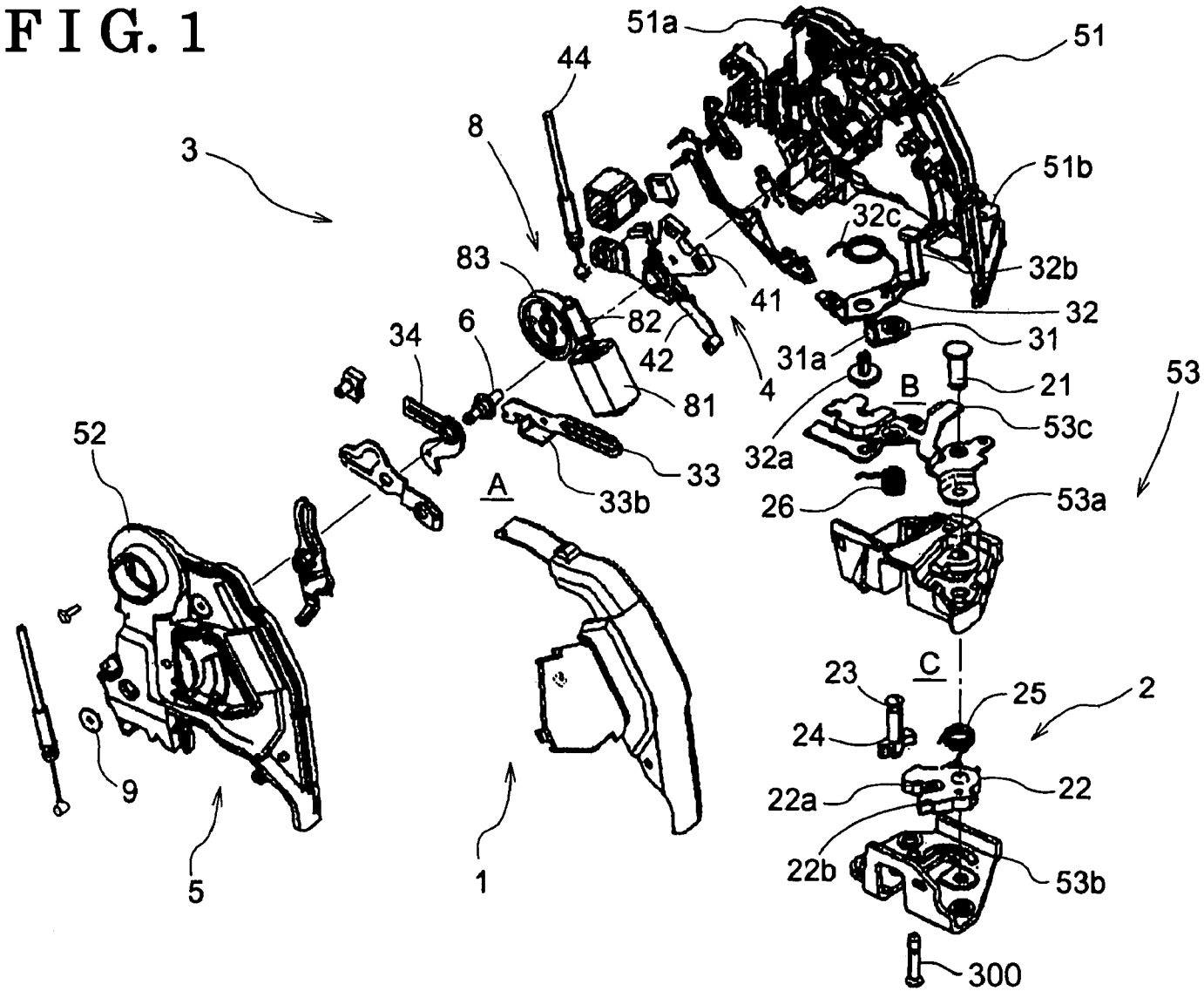
FIG. 1 is an exploded perspective view of a door lock apparatus according to an embodiment of the present invention.

As illustrated in FIG. 1, the door lock apparatus 1 is mainly configured with a latch mechanism 2, a link mechanism 3, a lock operation lever 4, a housing 5 in which the latch mechanism 2, the link mechanism 3 and the lock operation lever 4 are housed. The latch mechanism 2 is configured to hold the door Y at a closed condition by being selectively engaged with the striker 300 (FIG. 10) fixed to the body of the vehicle X. The link mechanism 3 operates the latch mechanism 2 such that the door Y can be opened. The lock operation lever 4 switches a condition of the link mechanism 3 or an open link 33 (described later) between a condition, in which the link mechanism 3 or the open link 33 operates the latch mechanism 2, and the other condition, in which the link mechanism 3 or the open link 33 does not operate the latch mechanism 2.

As further illustrated in FIG. 1, the housing 5 is mainly configured with a resin-made main case 51, a resin-made first cover 52 and a second cover 53. The main case 51 includes a first case portion 51*a* and a second case portion 51*b* which integrally extends at an approximately right angle to the first case portion 51*a*. The first cover 52 is joined to the main case 51 so as to overlap with the first case portion 51*a*, and a water-tight first housing space A is defined by the first cover 52 and the first case portion 51*a*. Likewise, the second cover 53 is joined to the main case 51 so as to overlap with the second case portion 51*b*, and a second housing space B is defined by the second cover 53 and the second case portion 51*b*. The second cover 53 is mainly configured with a box-type resin-made body 53*a*, a metal base plate 53*b* and a metal sub-base plate 53*c*. The base plate 53*b* is fitted together with the body 53*a*, and a third housing space C is defined by the base plate 53*b* and the body 53*a*. The body 53*a* is joined to the main case 51 via the sub-base plate 53*c*.

As still further illustrated in FIG. 1, the latch mechanism 2 is housed in the third housing space C and includes a latch 22, which is pivotally supported about a latch shaft 21 by the base plate 53*b*, and a pawl 24 which is pivotally supported about a pawl shaft 23 by the base plate 53*b* so as to engage with the latch 22. The latch 22 includes, at a circumferential side surface of the latch 22, a groove 22*a* for receiving the striker 300, and a pawl portion 22*b*, which is engaged with and disengaged from the pawl 24. The latch 22 is always rotatably biased in one direction by a spring 25, while the pawl 24 is always rotatably biased by a spring 26 in a direction that counters the biasing direction of the latch 22.

Figure 5:
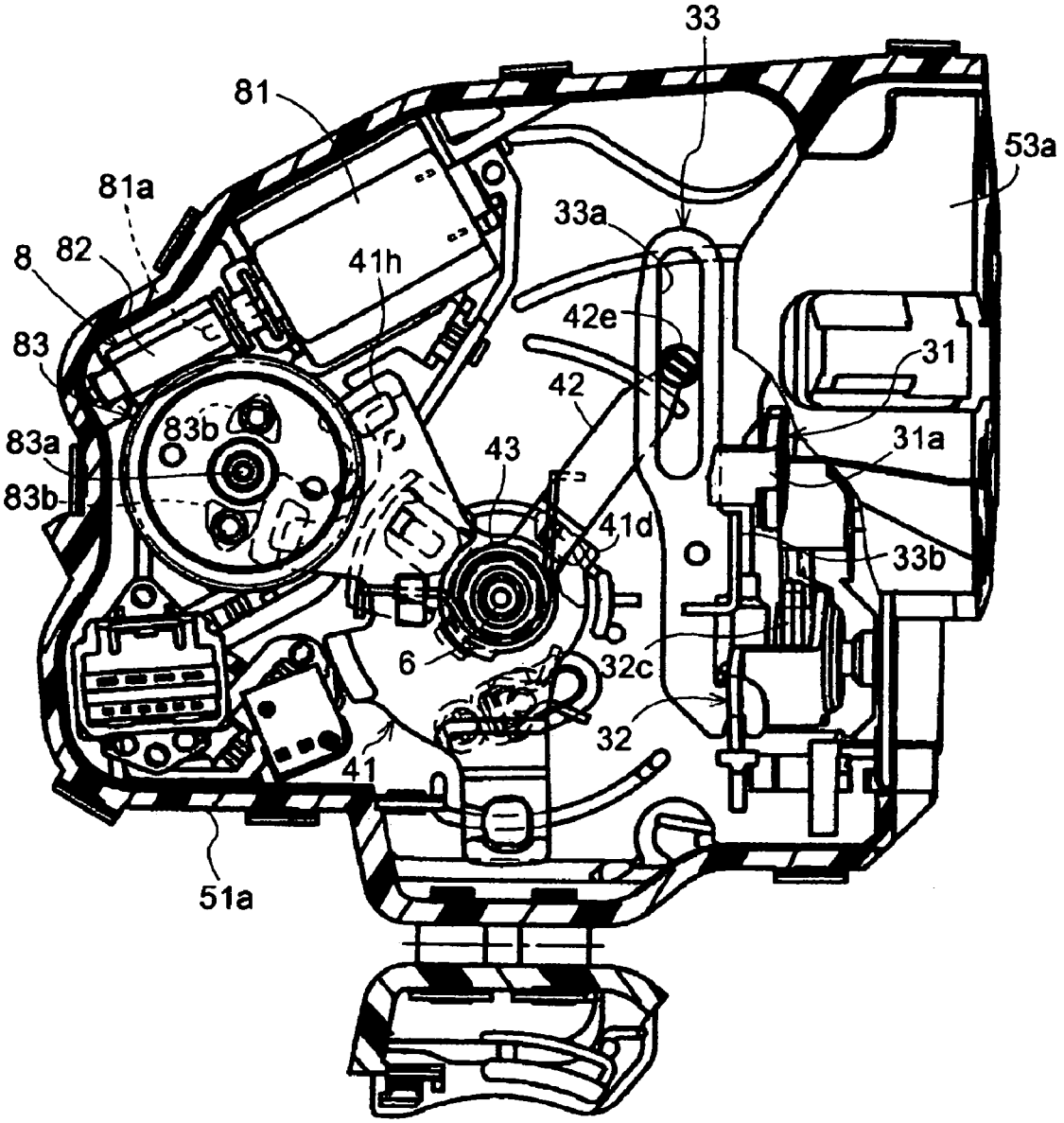
FIG. 5 is a front view illustrating a link mechanism and the lock operation lever of the door lock apparatus, each of which is at an unlock state.
Figure 7:
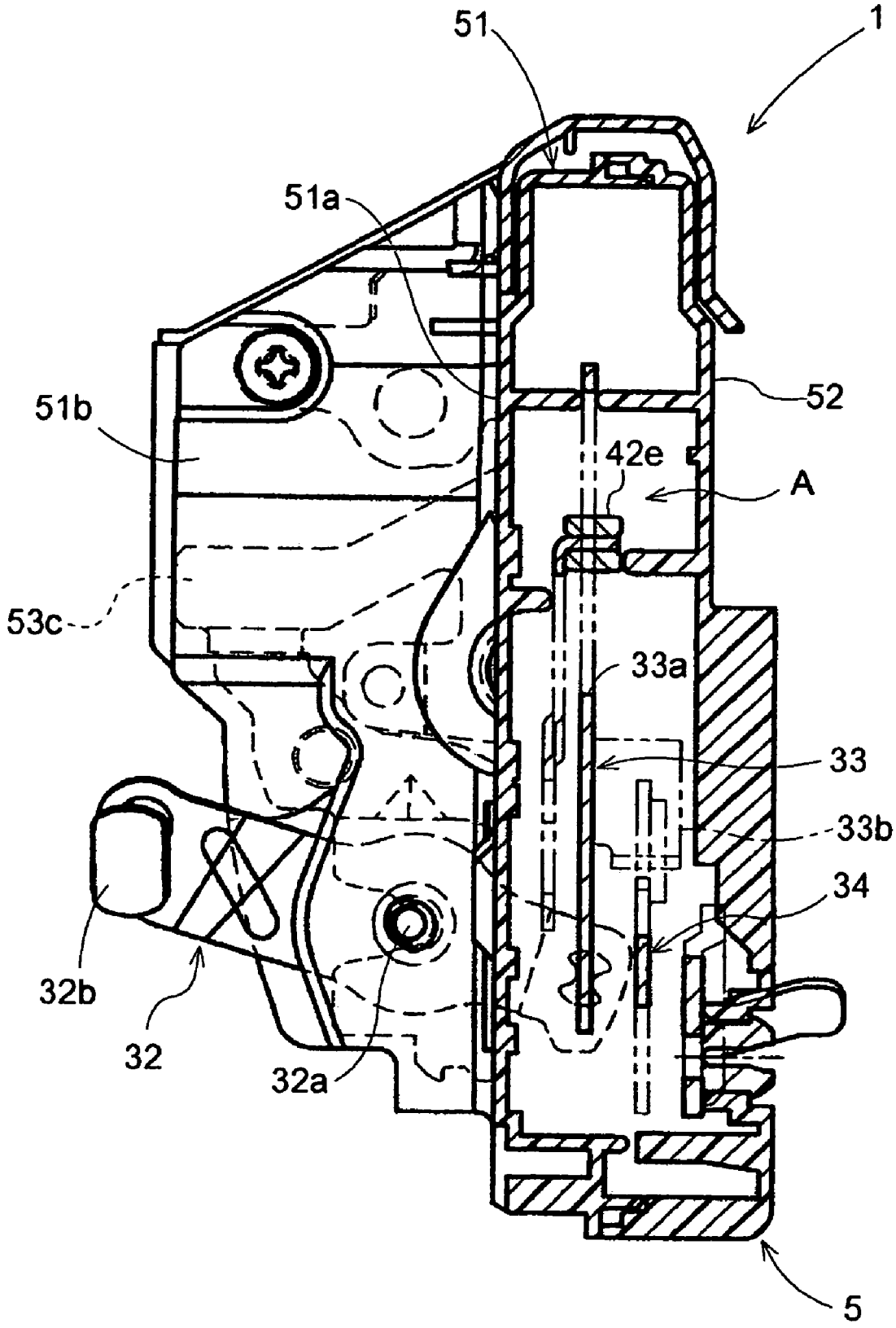
FIG. 7 is a front view of the door lock apparatus.

As illustrated in FIGS. 1, 5 and 7, the link mechanism 3 is mainly configured with a lift lever 31, an outside open lever 32, the open link 33 (i.e., a link member) and an inside open lever 34.

The lift lever 31 and the outside open lever 32 are housed in the second housing space B. The lift lever 31 is fixedly equipped to an extending portion of the pawl shaft 23 of the latch mechanism 2 within the second housing space B so that the lift lever 31 rotates integrally with the pawl shaft 23. The outside open lever 32 is freely rotatably supported by the sub-base plate 53*c* about a pin 32*a* that is fitted into and supported by the sub-base plate 53*c*. The outside open lever 32 is operatively associated with an outside door handle (FIG. 10) of the door Y by a linkage pin 32*b* that is upright at one end of the outside open lever 32. The outside open lever 32 is fixed with a spring 32*c* and is maintained at an initial position illustrated in FIG. 7 by a biasing force of the spring 32*c*.

The open link 33 and the inside open lever 34 is housed in the first housing space A. The open link 33 is arranged to substantially intersect with the outside open lever 32 and is supported by the other end of the outside open lever 32 so as to freely pivot between an unlock position illustrated in FIG. 5 and a lock position illustrated in FIG. 7. A long hole 33*a* (FIGS. 5 and 7) is formed at a tip end of the open link 33 and extends along a longitudinal direction of the open link 33. A flange wall 33*b*, which is an L-shaped structure and can contact with a flange wall 31*a* of the lift lever 31, is formed at a longitudinally intermediate portion of the open link 33. The inside open lever 34 is relatively rotatably supported by a supporting shaft 6, which is described later. An arm portion, which can come in contact with the flange wall 33*b* of the open link 33, is formed at one end of the inside open lever 34.

The inside open lever 34 is formed with a through hole of which circumferential edge is integral with an up-right flange wall. The inside open lever 34 is fitted with an outer peripheral portion of a first supporting portion 63 (FIG. 6) of the supporting shaft 6 from an outside and is freely rotatable relative to the first supporting portion 63. This structure of the inside open lever 34 is described in details later.

Returning to FIG. 1, the lock operation lever 4, which is housed in the first housing space A, is mainly configured with an active lever 41, a sub lever 42, and a spring 43. According to the embodiment of the present invention, such respective components are established as a sub-assembly (i.e., an assembly), i.e., are all contained in a sub-assembly (i.e., an assembly), so as to be integrally equipped to the door lock apparatus 1. The lock operation lever 4, in which such components are contained in the sub-assembly, is pivotably supported by a boss 7 (FIG. 6) of the main case 51 so as to be rotatable about the supporting shaft 6.

Figure 2:
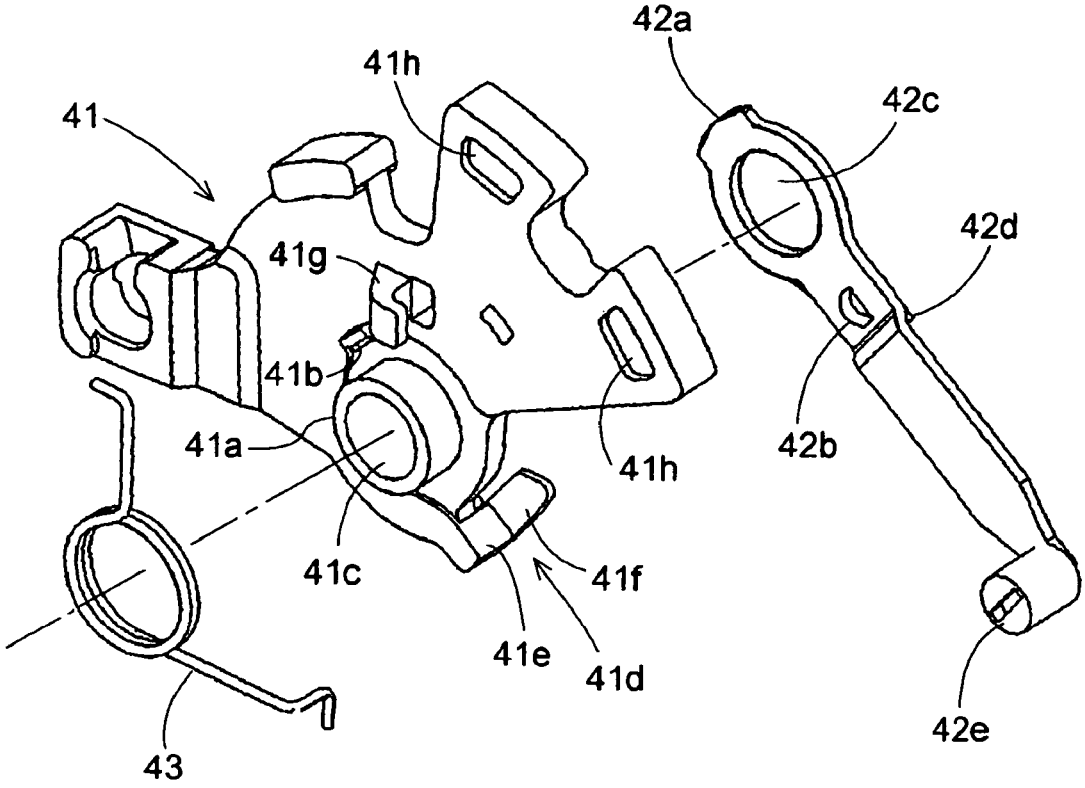
FIG. 2 is an exploded perspective view of a lock operation lever illustrated in FIG. 1.
Figure 3A:
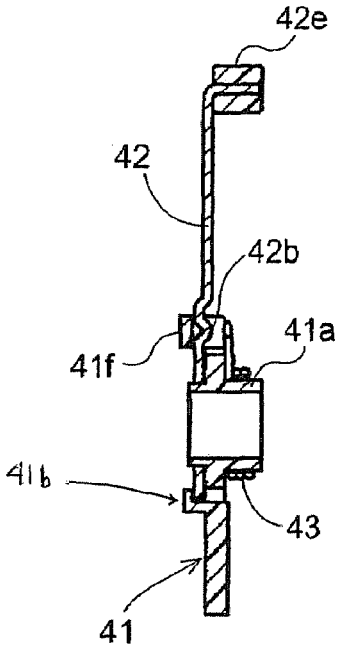
FIG. 3A is a sectional view illustrating the lock operation lever as an assembly, as seen from an active lever side.
Figure 3B:
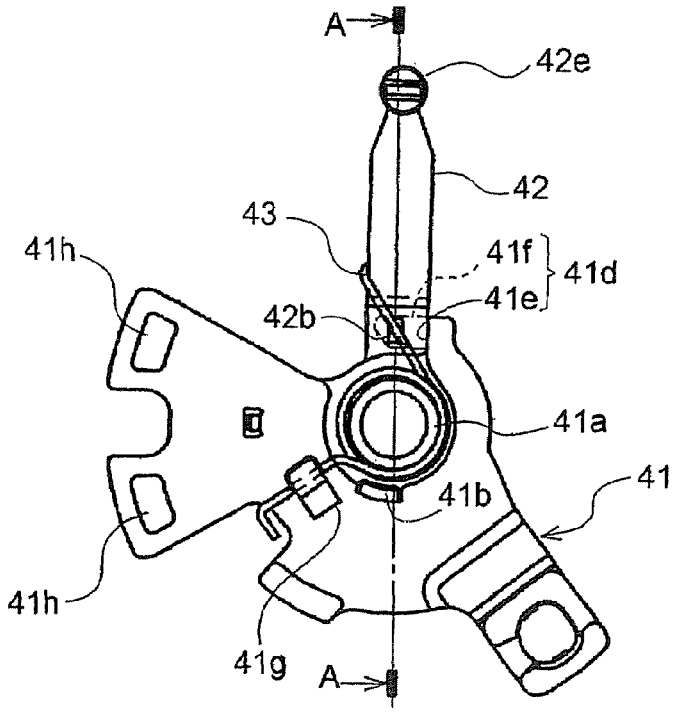
FIG. 3B is a front view illustrating the lock operation lever as an assembly, as seen from the active lever side.
Figure 4:
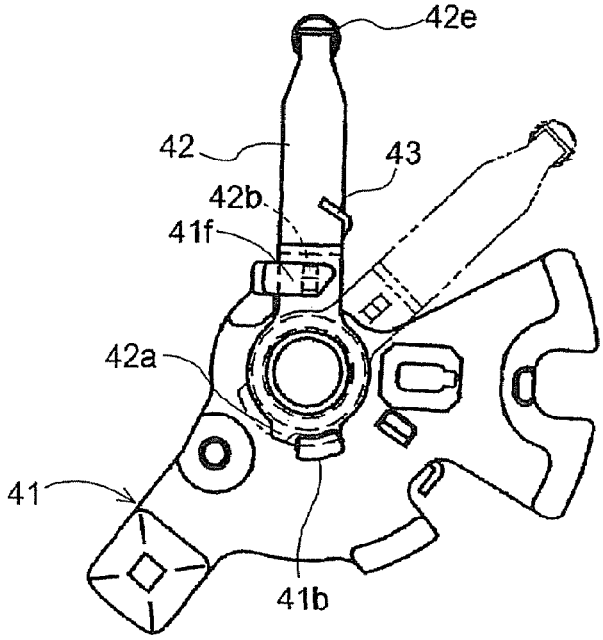
FIG. 4 is a front view illustrating the lock operation lever as an assembly, as seen from a sub lever side.
Figure 6:
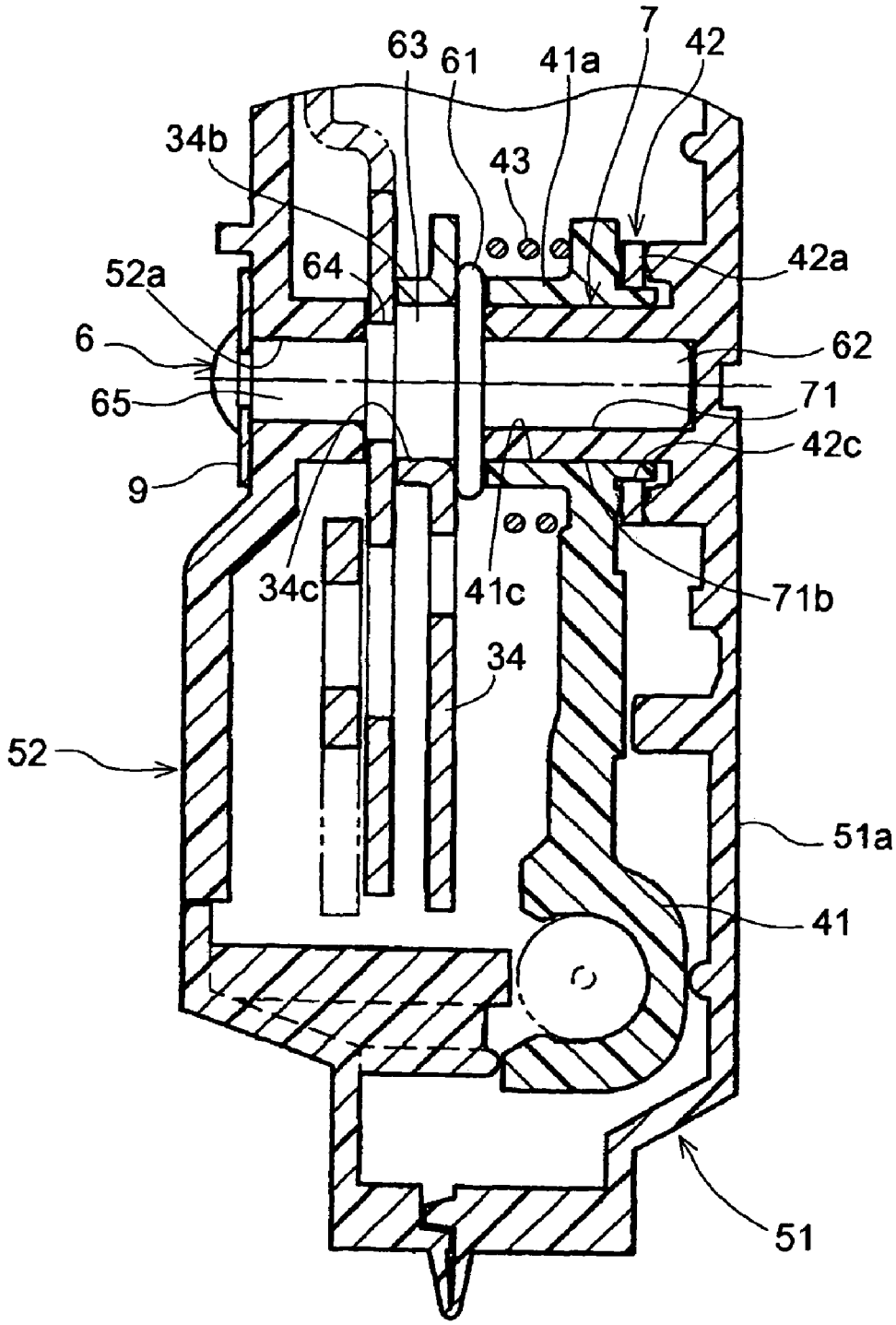
FIG. 6 is a sectional view of the door lock apparatus.

As illustrated in FIGS. 2, 3 and 6, a boss 41*a* is formed at the active lever 41. The boss 41*a* possesses a through hole 41*c* of which diameter is substantially the same as, or slightly greater than, a diameter of an outer peripheral surface 71*b* of the boss 7. The sub lever 42 possess a through hole 42*c* of which diameter is substantially the same as, or slightly greater than, a diameter of an outer peripheral surface of the boss 41*a* of the active lever 41. That is, the sub lever 42 is rotatably supported by the active lever 41 and is rotatable relative to the active lever 41, because the boss 41*a* of the active lever 41 extends through the through hole 42*c* of the sub lever 42. An assembling of the sub lever 42 to the active lever 41 is exerted by relatively rotating both the levers 41 and 42 and engaging or contacting the sub lever 42 with a sidewall portion 41*e* of a stopper 41*d* of the active lever 41. When the sub lever 42 is fitted together with the active lever 41, a one surface of the sub lever 42 impacts with a bottom portion 41*f* of the stopper 41*d* of the active lever 41 while an engagement protrusion 42*a* (i.e., an engagement portion) of the sub lever 42 is engaged with a recess 41*b* (i.e., an engaged portion) of the active lever 41. Therefore, the active lever 41 and the sub lever 42 can be prevented from dropping along a direction of a rotational axis of each (FIG. 4). If a wrong-side surface of the sub lever 42 is to become in contact with the active lever 41, a protrusion 42*b* provided on the sub lever 42 comes in contact with a side portion of the stopper 41*d*. In such cases, it is not possible to engage the engagement protrusion 42*a* and the recess 42*b*, due to the protrusion 42*b* that prevents the active lever 41 and the sub lever 42 from being wrongly assembled. Therefore, a wrong assembling of the sub lever 42 to the active lever 41, i.e., an adverse assembling of the sub lever 42 to the active lever 41, can be prevented. According to the embodiment of the present invention, the sub lever 42 is provided with the engagement portion, and the active lever 41 is provided with the engaged portion. However, the structure is not limited to the above. Alternatively or in addition, the sub lever 42 can be provided with an engaged portion and the active lever 41 can be provided with an engagement portion.

As is obvious from FIGS. 3 and 6, the spring 43 is attached to an outer periphery of the boss 41*a* of the active lever 41 at a side opposite to the sub lever 42. One end of the spring 43 is engaged with a spring engagement portion 41*g* of the active lever 41, while the other end thereof is engaged with a body of the sub lever 42. The sub lever 42 is hence biased by a biasing force of the spring 43 so as to come in contact with the sidewall portion 41*e* of the stopper 41*d*.

The supporting shaft 6 is a cylindrical shape and is formed with a flange 61 at an approximately axially intermediate portion of the supporting shaft 6. The supporting shaft 6 is formed with a fixed portion 62 at a side of a fixed end (a right side in FIG. 6) from the flange 61, a fixed portion 62 of which diameter is substantially the same as, or slightly greater than, a diameter of an inner peripheral surface 71 of the boss 7. The supporting shaft 6 is formed with a first supporting portion 63, a second supporting portion 64 and an inserting portion 65, at a side of a tip end (a left side in FIG. 6) from the flange 61. The first supporting portion 63 possesses a diameter that is greater than the diameter of the fixed portion 62. The second supporting portion 64 possesses a diameter that is smaller than the diameter of the first supporting portion 63. The inserting portion 65 possesses a diameter that is smaller than the diameter of the second supporting portion 64. The supporting shaft 6 is press-fitted into the boss 7 and is fitted into and joined to the main case 51 in such a manner that an outer peripheral surface of the fixed portion 62 comes in contact with the inner peripheral surface 71 of the boss 7. The inserting portion 65 is inserted into a flanged through hole 52*a* formed at the first cover 52 and is supported by the first cover 52 via a washer 9. Therefore, the supporting shaft 6 is supported, at both ends thereof, by the main case 51 and the first cover 52, i.e., by the housing 5.

As is apparent from FIGS. 1, 5, 8 and 9, an actuator 8 (i.e., a drive unit) having an electric motor 81 as a driving power source is placed in the first housing space A. A worm gear 82 is fixed to a rotational shaft 81*a* of the electric motor 81 so as to be rotatable integrally with the rotational shaft 81*a*. A wheel gear 83 is freely rotatably supported about a pin 83*a* on the main case 51 of the housing 5 and is gear-meshed with the worm gear 82. A pair of engagement protrusions 83*b* and 83*b* are formed at the wheel gear 83 so as to operatively appear inside engagement recesses 41*h* of the active lever 41 in response to rotation of the wheel gear 83 and to be engaged with the active lever 41. According to such configuration, when the electric motor 81 is activated in one direction, the wheel gear 83 rotates in a clockwise direction in FIG. 5 via the worm gear 82, such rotation which engages one of the engagement protrusions 83*b* and 83*b* with the engagement recess 41*f* of the active lever 41 and engages the one with the active lever 41. As a result, the active lever 41 and the sub lever 42 rotates in a counterclockwise direction in FIG. 1 (in a lock direction) as an integral unit via a stopper 42*d*. On the other hand, when the electric motor 81 is activated in the other direction, the wheel gear 83 rotates in a counterclockwise direction in FIG. 5 via the worm gear 82, such rotation which engages the one of the engagement protrusions 83*b* and 83*b* with the engagement recess 41*f* of the active lever 41 and engages the one with the active lever 41. As a result, the active lever 41 rotates in a clockwise direction in FIG. 5 (i.e., an unlock direction). In this case, the sub lever 42 rotates in a clockwise direction in FIG. 5 in association with the active lever 41 via the spring 43.

Next, described below is a fundamental operation of the door lock apparatus 1. FIG. 5 illustrates conditions or positions of the link mechanism 3 and the lock operation lever 4 when the door Y is maintained at a closed condition and at an unlock condition by the latch mechanism 2 of the door lock apparatus 1. In such conditions, the outside open lever 32 is placed at the initial position illustrated in FIG. 7.

Under the condition illustrated in FIG. 5, when the outside door handle 100 of the door Y is operated, the outside open lever 32 is rotated from the initial position in a counterclockwise direction in FIG. 7, in which the open link 33 is shifted upwardly in FIGS. 5 and 7. The flange wall 33*b* of the open link 33 then comes in contact with the flange wall 31*a* of the lift lever 31, wherein the lift lever 31 is rotated. As a result, the latch mechanism 2 is operated from a latch condition to an unlatch condition so that the door Y is opened.

Figure 8:
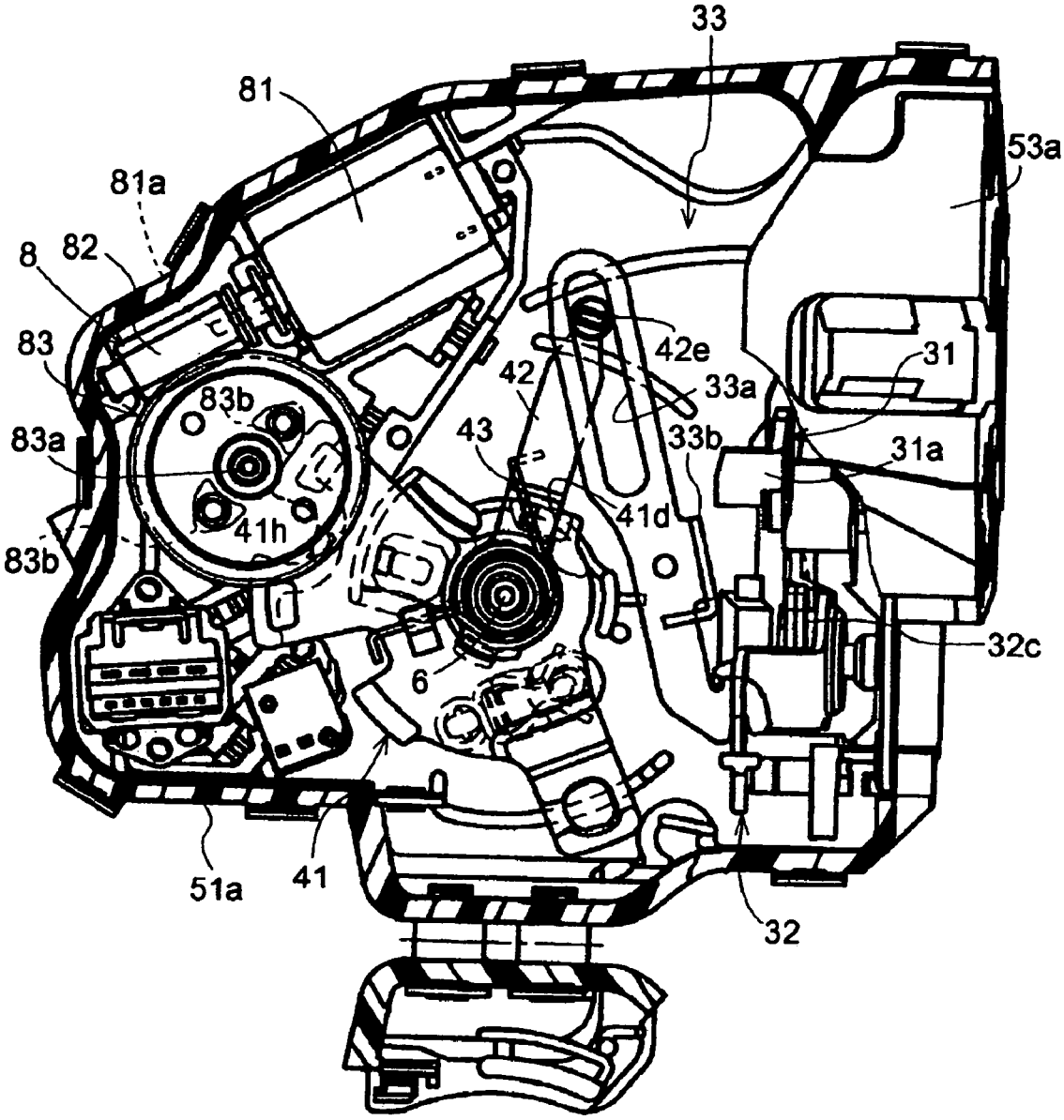
FIG. 8 is a front view illustrating the link mechanism and the lock operation lever of the door lock apparatus, each of which is at a lock state.

Referring to FIGS. 5 and 8, when the lock operation lever 4 is rotated in a lock direction by activating the electric motor 81 or by operating an inside lock knob, the rotation of the lock operation lever 4 is transmitted to the open link 33 via the a bush 42*e*, and the open link 33 is pivoted in a counterclockwise direction in FIG. 5. As a result, the open link 33 is switched from an unlock position to a lock position (FIG. 8). In this state, the flange wall 31*a* of the lift lever 31 does not appear or exist on an operation path of the flange wall 33*b* of the open link 33, an operation path which is generated in response to operation of the open link 33. Therefore, even if an inside door handle, or the outside door handle 100 of the door Y is operated, the flange wall 33*b* does not come in contact with the flange wall 31*a* (FIG. 9), wherein the door Y is not opened. In order to return the condition or position of the open link 33 to the condition illustrated in FIG. 5, the lock operation lever 4 can be rotated in an unlock direction by activating the electric motor 81, or by operating the inside lock portion, in a reverse direction to the described above.

Next, described below is an operation of the door lock apparatus 1 in case where a door opening operation and a door unlock operation are implemented at or about the same time under the door lock condition.

Figure 9:
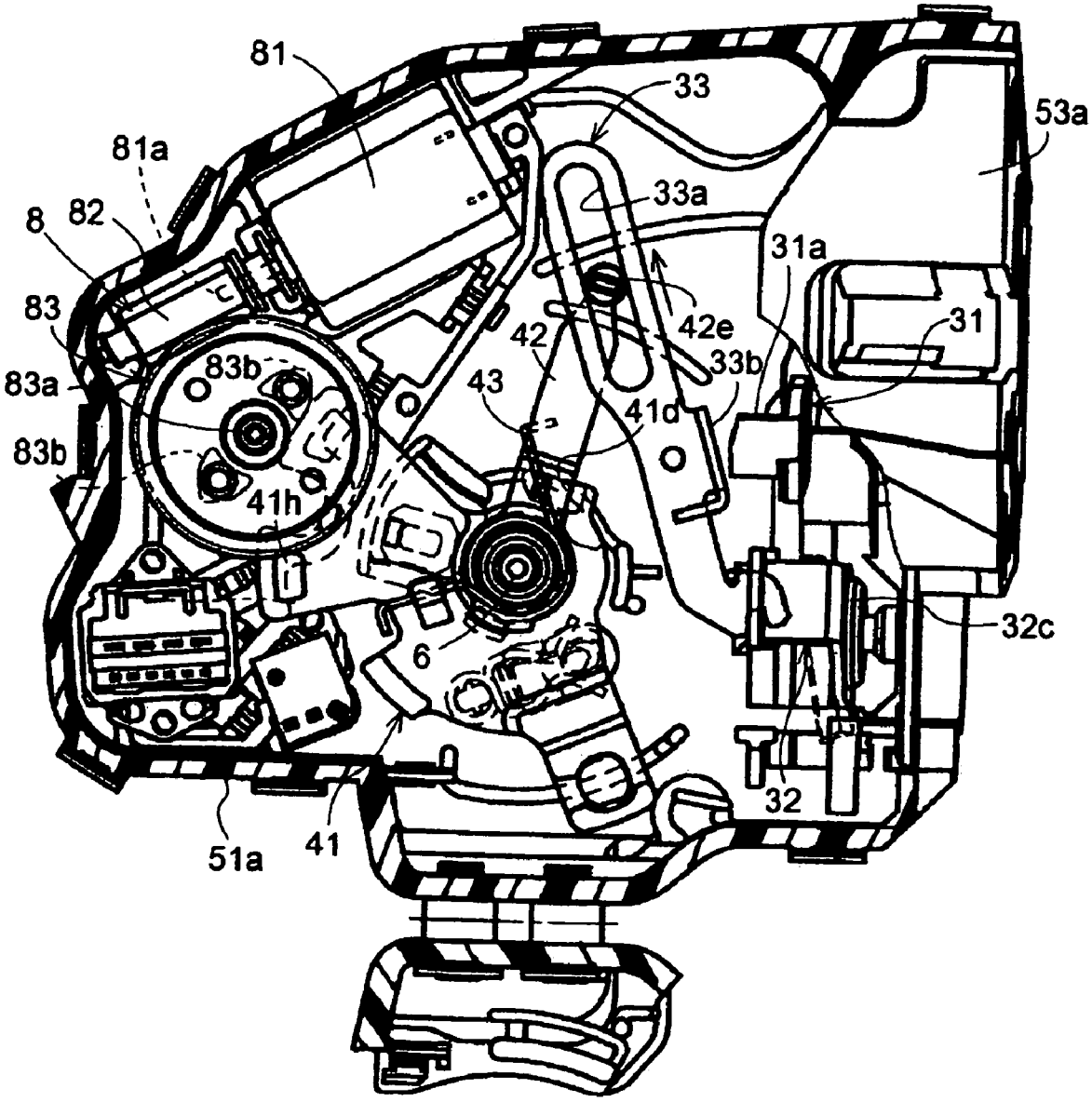
FIG. 9 is a front view illustrating the link mechanism and the lock operation lever of the door lock apparatus when a door opening operation is carried out at the lock state.

When a door opening operation is implemented under the door lock condition, the open link 33 is shifted approximately upwardly. However, as described above, the open link 33 doest not come in contact with the lift lever 31 (FIG. 9). If an unlock operation is implemented under the aforementioned condition, the open link 33 is rotated in a clockwise direction in FIG. 9 and comes in contact with a side portion of the lift lever 31, wherein the rotation of the open link 33 is stopped by such contact. However, because the spring 43 enables a relative rotation between the sub lever 42 and the active lever 41, the active lever 41 can be shifted to the unlock position against the biasing force of the spring 43. Once the door opening operation is discontinued under the aforementioned condition, such contact between the open link 33 and the lift lever 31 is released, and the sub lever 42 is shifted to the unlock position by the biasing force of the spring 43. As described above, a condition or position of the open link 33, i.e. a condition of the door lock apparatus 1, can be shifted from the lock condition (the lock position) to the unlock condition (the unlock position in FIG. 5). That is, according to the embodiment of the present invention, even if a state of panic occurs under the door lock condition, due to the operation of the door opening operation at or about the same time as the unlocking operation, the door lock apparatus 1 or the open link 33 can easily return to the unlock condition.

As described above, according to the embodiment of the present invention, it is possible to provide the high-quality door lock apparatus 1, in which the lock operation lever 4 can be easily fitted together within the door lock apparatus 1, and which can easily return from a state of panic.

According to the embodiment of the present invention, the door lock apparatus 1 is adjusted to the door Y out of two side doors of the vehicle X. Alternatively or in addition, the door lock apparatus 1 can be adjusted to the other door out of the two side doors. In such cases, the structure of an active lever 41 for the other side door could be symmetrical relative to the structure of the active lever 41 described above, while the same sub lever 42 could be employed.

Further, according to the embodiment of the present invention, the lock operation lever 4 is operated by the electric actuator. Alternatively or in addition, the lock operation lever 4 can be operated by other means such as in a manual manner by which the lock operation lever 4 is rotated by a key inserted into a keyhole formed at an outer panel of the door.

Figure 11:
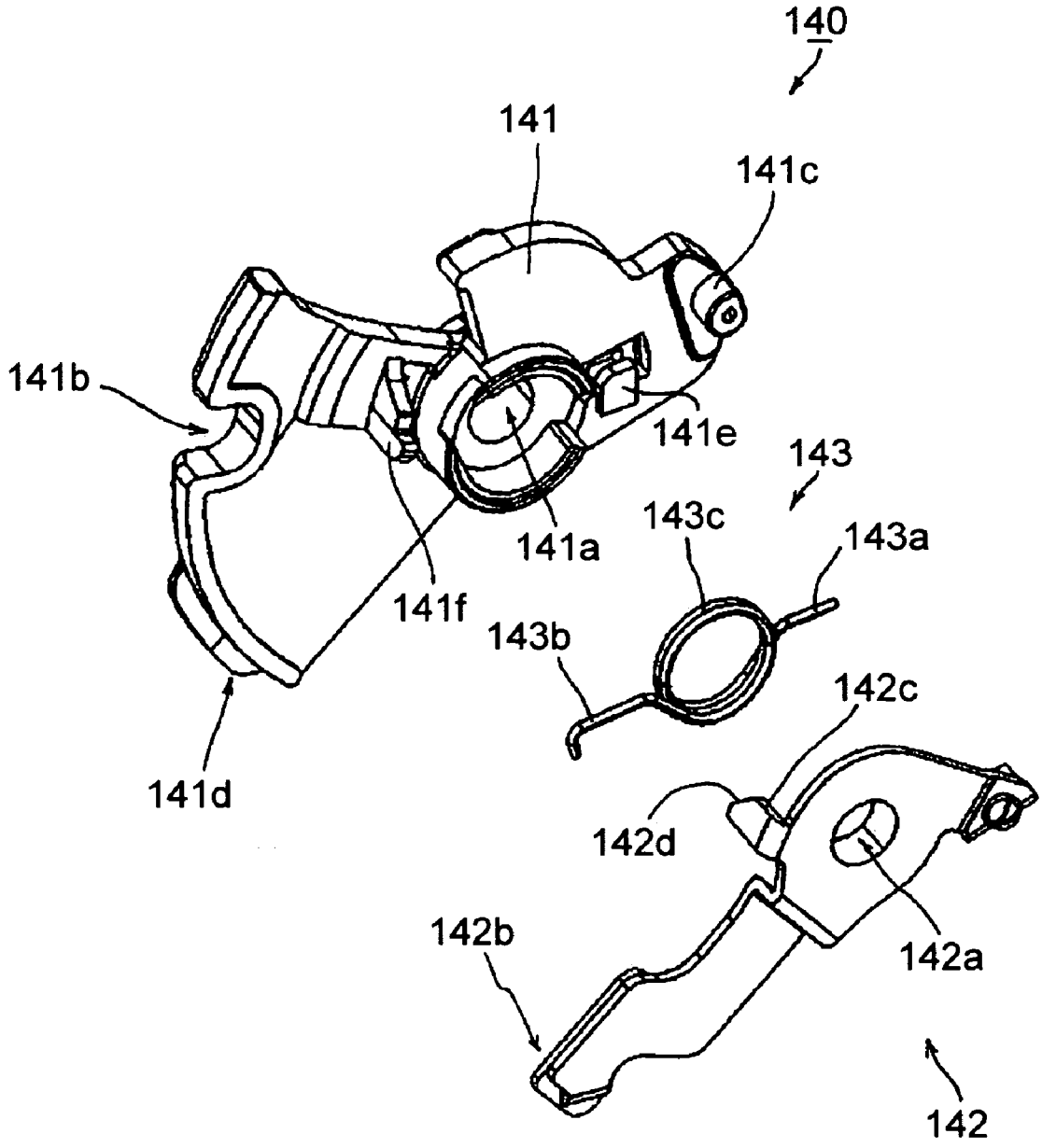
FIG. 11 is an exploded perspective view of a lock operation lever according to a modified example.

Next, described below is a modified example of the door lock apparatus 1 according to the embodiment of the present invention, with reference to FIG. 11.

A lock operation lever 140 of a door lock apparatus 1 according to the modified example includes an active lever 141, a sub lever 142, and a torsion spring 143. The active lever 141 is formed with a through hole 141*a*, a concave portion 141*b*, convex portions 141*c* and 141*d*. The sub lever 142 is formed with a through hole 142*a* and a pin 142*b*. The sub lever 142 is relatively rotatably supported by the active lever 141 about the through hole 142*a* into which a supporting shaft 61 extends. The torsion spring 143 (a biasing means) is provided between the active lever 141 and the sub lever 142. The torsion spring 143 is employed to generate a torque, which operates in its coiled direction, at one end 143*a* (the other end 143*b*) thereof.

The one end 143*a* of the torsion spring 143 is held by a holding portion 141*e* (i.e., a first holding portion) of the active lever 141, while the other end 143*b* thereof is engaged with an engagement surface 142*c* (an engagement portion) of the sub lever 142. The active lever 141 is further formed with a temporary holding portion 141*f* (i.e., a second holding portion) at a position that exists away in an unlock direction from the engagement surface 142*c* of the sub lever 142. This temporary holding portion 141*f* can hold the other end 143*b* of the torsion spring 143. The sub lever 142 is further provided with a surface 142*d* (i.e., a guide portion) which continuously extends from the engagement surface 142*c*. According to this modified example, although the surface 142*d* is a slope relative to the engagement surface 142*c*, the structure of the surface 142*d* is not limited to the above. The surface 142*d* can be, for example a curved surface continuously extending from the engagement surface 142*c*.

Figures 12A, 12B, 12C, 12D:
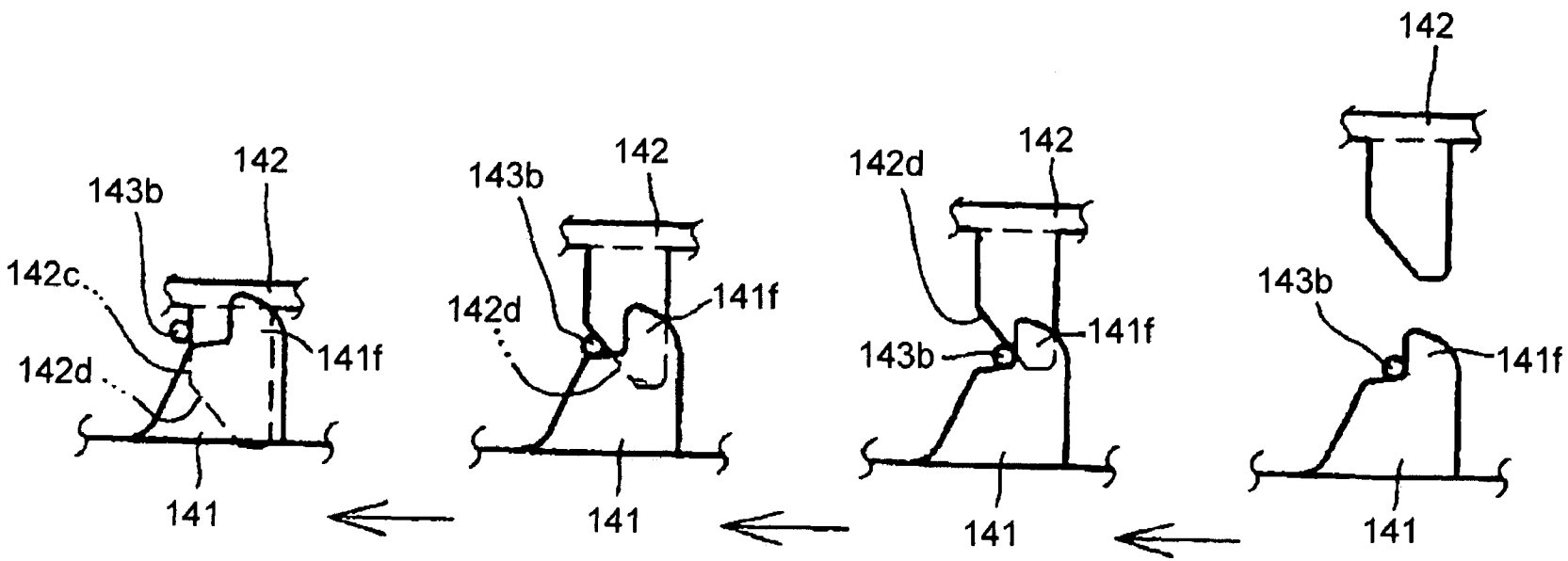
FIGS. 12A to 12D are views for explaining a process of assembling the lock operation lever according to the modified example.

FIGS. 12A to 12*d* are explanatory views for schematically explaining operations of the sub lever 142 and the other end 143*b* of the torsion spring 143 according to the modified example. FIG. 12A illustrates a stage prior to assembling the sub lever 142 to the active lever 141, in which the other end 143*b* of the torsion spring 143 is held by the temporary holding portion 141*f* of the active lever 141. FIG. 12B illustrates an initial stage of assembling the sub lever 142 to the active lever 141, in which the surface 142*d* of the sub lever 142 is in contact with the other end 143*b* of the torsion spring 143 held by the temporary holding portion 141*f*. In such conditions, the surface 142*d* of the sub lever 142 pushes the other end 143*b* in a left side in FIG. 12 against the biasing force of the torsion spring 143 while being slidably in contact with the other end 143*b* of the torsion spring 143, as illustrated in FIG. 12C. When the surface 142*d* of the sub lever 142 further pushes the other end 143*b* against the biasing force of the torsion spring 143, the engagement surface 142*c* of the sub lever 142 is ultimately engaged with the other end 143*b* of the torsion spring 143, as illustrated in FIG. 12D. That is, the other end 143*b* of the torsion spring 143 is guided to the engagement surface 142*c* of the sub lever 142 by the surface 142*d* of the sub lever 142 against the biasing force of the torsion spring 143.

As is apparent from FIGS. 12A to 12D, as for a series of assembling work of the lock operation lever 140, the active lever 141, which holds the torsion spring 143, and the sub lever 142 are assembled in one direction. Therefore, as for such assembling work, it is possible to employ for example a device for automatically assembling components.

As described above, the torsion spring 143 can be in advance held by the holding portion 141*e* and the temporary holding portion 141*f* of the active lever 141. In such circumstances, because the main lever 141 and the torsion spring 143 can in advance unite, there is no need to hold such components respectively.

As is further apparent from FIGS. 12A to 12D, the other end 143*b* of the torsion spring 143, which is held by the temporary holding portion 141*f* of the active lever 141, is pushed in the other direction while being slidably in contact with the surface 142*d* of the sub lever 142. The other end 143*b* of the torsion spring 143 is then ultimately engaged with the engagement surface 142*c* of the sub lever 142.

As described above, the lock operation lever 140 can be assembled with a high efficiency by a combination of a work for holding in advance the torsion spring 143 by the active lever 141 and a simple work for operating both the active lever 141 holding the torsion spring 143 and the sub lever 142 in the same direction.

According to the modified example, because the surface 142*d* is a slope relative to the engagement surface 142*c*, the other end 143*b* of the torsion spring 143 can be engaged with the engagement surface 142*c* more smoothly. Therefore, it is possible to assemble the lock operation lever 140 with much higher efficiency.

As described above, according to the embodiment and the modified example of the present invention, when the link member 33 is shifted to the lock position, the sub lever 42 or 142 is operated integrally with the active lever 41 or 141. On the other hand, when the link member 33 is shifted to the unlock position, the sub lever 42 or 142 is associated with the active lever 41 or 141 via the biasing member 43 or 143. Therefore, even if a state of panic comes up due to an operation of the lock operation lever 4 or 140 which is carried out at or about the same time as an operation of the inside or outside open lever 32 or 34, the link member 33 or the door lock apparatus 1 can easily return to the unlock position.

The lock operation lever 4 or 140 is built as a sub-assembly containing the active lever 41 or 141, the sub lever 42 or 142 and the biasing member 43 or 143. The lock operation lever 4 or 140 hence can be assembled, as a unit, to the door lock apparatus 1. As a result, when the lock operation lever 4 or 140 is assembled to or fitted together with the door lock apparatus 1, comparing with assembling components respectively to the door lock apparatus 1, efficiency in assembling the lock operation 4 or 140 to the door lock apparatus 1 can be improved. Further, a process of manufacturing the door lock apparatus 1 can be simplified Further, one of the active lever 41 or 141 and the sub lever 42 or 142 can be interposed between the biasing member 43 or 143 and the other one of the active lever 41 or 141 and the sub lever 42 or 142. In such cases, the operation lever 4 or 140 can be reliably integrated as a sub-assembly. As a result, an assembling of the lock operation lever 4 or 140 to the door lock apparatus 1 can be easier and efficiency in the assembling can be improved. Further, there is no danger that components of the lock operation lever 40 or 140 as such sub-assembly would be disjointed, and such sub-assembly can be kept in stock easily. Therefore, it is possible to enhance efficiency of a process of manufacturing the door lock apparatus 1 and to reduce a manufacturing cost thereof.

Still further, the one of the active lever 41 or 141 and the sub lever 42 or 142 includes a boss 41*a* about a rotational axis of the one, and the biasing member is provided at an outer periphery of the boss. Therefore, when the lock operation lever 4 or 140 is built as a sub-assembly, mounting of the biasing member 43 or 143 to the interposed lever can become easier. It is still possible to first mount one of the other lever or the biasing member to the interposed lever. Therefore, the lock operation lever 4 or 140 can be built as a sub-assembly easily and a degree of freedom in the process of building as the sub-assembly can be enhanced. As a result, it is possible to enhance efficiency in the process of building as the sub-assembly and to reduce a cost, which leads to reduction of the manufacturing cost of the door lock apparatus 1. Moreover, the biasing member 43 or 143 can be mounted on a outer periphery of the boss. In such circumstances, there is no danger that the biasing member 43 or 143 could be dropped, and the lock operation lever 4 or 140 could be integrated as a strongly-joint sub-assembly. As a result, assembling of the lock operation lever 4 or 140 to the door lock apparatus 1 can become easier, and efficiency in the assembling can be enhanced. There is no danger that components of the lock operation lever 4 or 140 as the sub-assembly could be disjointed, and such sub-assemblies can be kept in stock and be transported easily.

Still further, the active lever 41 or 141 and the sub lever 42 or 142 respectively include at least one of an engagement portion 42*a* and an engaged portion 41*g* by which the active lever 41 or 141 and the sub lever 42 or 142 are prevented from dropping along a rotational axis when the active lever 41 or 141 and the sub lever 42 or 142 are at an assembled state. In such cases, for example, when the biasing member 43 or 143 are fitted together after fitting together the sub lever 42 or 142 and the active lever 41 or 141, it is possible to prevent the active lever 41 or 141 and the sub lever 42 or 142 from being disjointed again. As a result, the lock operation lever 4 or 140 can be more easily built as a sub-assembly, and a cost required for a process of building as the sub-assembly can be reduced.

Still further, the engagement portion 42*a* is provided at one of the active lever 41 or 141 and the sub lever 42 or 142 and is at least a protrusion extending radially from the rotational axis, and the engaged portion 41*g* is provided at an other one of the active lever 41 or 141 and the sub lever 42 or 142 and is a recess engageable with the protrusion. The protrusion and the recess are engaged with each other by moving the active lever and the sub lever toward each other along the rotational axis and rotating one of the active lever and the sub lever to a predetermined position that substantially corresponds to an angular velocity vector (rad/s) of the one of the active lever and the sub lever relative to the other one thereof (i.e., a predetermined relative angular velocity position). In such circumstances, for example when the sub lever 42 or 142 is mounted to the active lever 41 or 141, an engagement operation between the levers can become very easy. Moreover, after the engagement operation, the engagement portion and the engaged portion can fit together with high reliability. As a result, the lock operation lever 4 or 140 can be built as a sub-assembly easily and a cost required for the process of building the sub-assembly can be reduced.

Still further, the sub lever 42 or 142 is provided with a protrusion 42*d* which is configured to prevent a surface the sub lever 42 or 142 from impacting with the active lever 41 or 141, the surface which is different from a surface of the sub lever 42 or 142 that comes in contact with the active lever 41 or 141 when assembling the active lever 41 or 114 and the sub lever 42 or 142. In such circumstances, it is possible to prevent an incorrect assembling of the sub lever 42 or 142 relative to the active lever 41 or 141. As a result, it is possible to prevent an occurrence of a defective product of the lock operation lever 4 or 140 and to enhance efficiency of the process of building the lock operation lever 4 or 140 as a sub-assembly.

The principles, a preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A door lock apparatus for a vehicle comprising:

a latch mechanism holding a door of the vehicle at a closed condition relative to a body of the vehicle;

an inside open lever and an outside open lever activated in response to respective operations of a door handle provided inside the door and a door handle provided outside the door;

a link member interposed between the latch mechanism and each of the inside open lever and the outside open lever and selectively operated between an unlock position and a lock position, the unlock position in which operations of the respective inside and outside open levers are transmitted to the latch mechanism, and the lock position in which the operations are not transmitted to the latch mechanism;

a drive unit activated to switch a position of the link member between the unlock position and the lock position; and a lock operation lever configured to transmit a driving power source of the drive unit to the link member and including an active lever operatively associated with the drive unit and a sub lever operatively associated with the link member, the sub lever having a common rotational axis with the active lever and configured to operate integrally with the active lever when the link member is switched to the lock position and to cooperate with the active lever via a biasing member when the link member is switched to the unlock position, the lock operation lever being an assembly containing the active lever, the sub lever and the biasing member, wherein the sub lever includes an engagement portion and the active lever includes an engaged portion by which the active lever and the sub lever are prevented from dropping along the rotational axis when the active lever and the sub lever are at an assembled state, the engagement portion is a protrusion extending radially from the rotational axis, and the engaged portion is a recess opening to the rotational axis and engageable with the protrusion, the protrusion and the recess are engaged with each other by rotating one of the active lever and the sub lever around the other of the active lever and the sub lever, the active lever further including a stopper extending axially to stop relative rotation between the active lever and the sub lever, and a projected portion of the stopper being engageable with the sub lever, and the recess, which serves as the engaged portion, includes a portion extending in a direction orthogonal to the rotational axis of the sub lever, the protrusion, which serves as the engagement portion of the sub lever, is supported in the axial direction between the extending portion and a main body of the active lever, the stopper formed at the active lever includes a sidewall portion having a surface parallel to the axial direction of the active lever and a bottom portion extending from the sidewall portion in the direction orthogonal to the axial direction of the active lever, and the sub lever is supported between the main body and the bottom portion in the axial direction.

2. A door lock apparatus for a vehicle according to claim 1, wherein one of the active lever and the sub lever is interposed between the biasing member and an other one of the active lever and the sub lever.

3. A door lock apparatus for a vehicle according to claim 2, wherein the one of the active lever and the sub lever includes a boss about a rotational axis of the one, and the biasing member is provided at an outer periphery of the boss.

4. A door lock apparatus for a vehicle according to claim 2, wherein the protrusion and the recess are engaged with each other by moving the active lever and the sub lever toward each other along the rotational axis and rotating one of the active lever and the sub lever to a predetermined relative angular position.

5. A door lock apparatus for a vehicle according to claim 2, wherein the projected portion of the stopper projects to the rotational direction of the sub lever.

6. A door lock apparatus for a vehicle according to claim 1, wherein the protrusion and the recess are engaged with each other by moving the active lever and the sub lever toward each other along the rotational axis and rotating one of the active lever and the sub lever to a predetermined relative angular position.

7. A door lock apparatus for a vehicle according to claim 6, wherein the protrusion is configured to prevent a surface of the sub lever from impacting with the active lever, the surface which is different from a surface of the sub lever that comes in contact with the active lever when assembling the active lever and the sub lever.

8. A door lock apparatus for a vehicle according to claim 1, wherein the protrusion is configured to prevent a surface of the sub lever from impacting with the active lever, the surface being different from a surface of the sub lever that comes in contact with the active lever when assembling the active lever and the sub lever.

9. A door lock apparatus for a vehicle according to claim 1, further comprising:

a first holding portion provided at the active lever and holding one end of the biasing member;

a second engagement portion provided at the sub lever and engaged with an other end of the biasing member;

a second holding portion provided at a position of the active lever, the which exists away in one direction from the second engagement portion of the sub lever, and configured to hold the other end of the biasing member; and a guide portion provided following the second engagement portion of the sub lever and configured to guide the other end of the biasing member to the second engagement portion against a biasing force of the biasing member.

10. A door lock apparatus for a vehicle according to claim 9, wherein the guide portion is a surface sloping relative to the second engagement portion.

11. A door lock apparatus for a vehicle according to claim 1, wherein the projected portion of the stopper projects to the rotational direction of the sub lever.

12. A door lock apparatus for a vehicle according to claim 11, wherein the protrusion and the recess are engaged with each other by moving the active lever and the sub lever toward each other along the rotational axis and rotating one of the active lever and the sub lever to a predetermined relative angular position.

13. A door lock apparatus for a vehicle according to claim 11, wherein the protrusion is configured to prevent a surface of the sub lever from impacting with the active lever, the surface which is different from a surface of the sub lever that comes in contact with the active lever when assembling the active lever and the sub lever.

14. A door lock apparatus for a vehicle according to claim 11, wherein the engaged portion and the projected portion are substantially symmetric about the rotational axis.

15. A door lock apparatus for a vehicle according to claim 1, wherein the protrusion is formed at the sub lever so as to protrude from a side of the bottom portion of the stopper in the axial direction.

16. A door lock apparatus for a vehicle comprising:

a latch mechanism holding a door of the vehicle at a closed condition relative to a body of the vehicle;

an inside open lever and an outside open lever activated in response to respective operations of a door handle provided inside the door and a door handle provided outside the door;

a link member interposed between the latch mechanism and each of the inside open lever and the outside open lever and selectively operated between an unlock position in which operations of the respective inside and outside open levers are transmitted to the latch mechanism and a lock position in which the operations are not transmitted to the latch mechanism;

a drive unit activated to switch a position of the link member between the unlock position and the lock position;

and a lock operation lever configured to transmit a driving power source of the drive unit to the link member and including an active lever operatively associated with the drive unit and a sub lever operatively associated with the link member, the sub lever having a common rotational axis with the active lever and configured to operate integrally with the active lever when the link member is switched to the lock position and to cooperate with the active lever via a biasing member when the link member is switched to the unlock position, the lock operation lever being an assembly containing the active lever, the sub lever and the biasing member, wherein the active lever includes a stopper extending axially so as to stop relative rotation between the active lever and the sub lever, and a projected portion formed at the stopper projects to the rotational direction of the sub lever and is engageable with the sub lever such that the active lever and the sub lever are prevented from dropping along the rotational axis, the sub lever includes a protrusion extending radially from the rotational axis and the active lever includes a recess opening to the rotational axis and engageable with the protrusion, and the recess includes a portion extending in a direction orthogonal to the rotational axis of the sub lever, the protrusion is supported in the axial direction between the extending portion and a main body of the active lever, the stopper formed at the active lever includes a sidewall portion having a surface parallel to the axial direction of the active lever and a bottom portion extending from the sidewall portion in the direction orthogonal to the axial direction of the active lever, and the sub lever is supported between the main body and the bottom portion in the axial direction.

17. A door lock apparatus for a vehicle according to claim 16, wherein the sub lever includes an engagement portion and the active lever includes an engaged portion by which the active lever and the sub lever are prevented from dropping along the rotational axis when the active lever and the sub lever are at an assembled state, the engagement portion is a protrusion extending radially from the rotational axis, and the engaged portion is a recess opening to the rotational axis and engageable with the protrusion, and the protrusion and the recess are engaged with each other by rotating one of the active lever and the sub lever around the other of the active lever and the sub lever.

18. A door lock apparatus for a vehicle according to claim 17, wherein the engaged portion and the projected portion are substantially symmetric about the rotational axis.

19. A door lock apparatus for a vehicle according to claim 16, wherein the protrusion is formed at the sub lever so as to protrude from a side of the bottom portion of the stopper in the axial direction.

* * * * *